United States Patent [19]

Sugiura

[11] Patent Number: 4,541,381

[45] Date of Patent: Sep. 17, 1985

[54] SYSTEM FOR CONTROLLING THE IGNITION TIMING OF AN ENGINE

[75] Inventor: Katsuhiko Sugiura, Tama, Japan

[73] Assignee: Fuji Jukogyo Kabushiki Kaisha, Tokyo, Japan

[21] Appl. No.: 587,738

[22] Filed: Mar. 8, 1984

[30] Foreign Application Priority Data

Mar. 10, 1983 [JP] Japan ..... 58-39736

[51] Int. Cl.[4] ..... F02P 5/04

[52] U.S. Cl. ..... 123/407; 123/406

[58] Field of Search ..... 123/407, 408, 409, 406

[56] References Cited

U.S. PATENT DOCUMENTS 2,559,859 7/1951 Elliott et al. ..... 123/407
3,203,411 8/1965 Seiden ..... 123/146.5 R

FOREIGN PATENT DOCUMENTS 2906243 8/1980 Fed. Rep. of Germany ..... 123/408
123366 9/1980 Japan ..... 123/407
123367 9/1980 Japan ..... 123/407
99066 8/1981 Japan .

*Primary Examiner*—Tony M. Argenbright
*Attorney, Agent, or Firm*—Martin A. Farber

[57] ABSTRACT

A system for controlling the ignition timing of an engine provided with a supercharger. The system comprises a vacuum advance device comprising two chambers defined by a diaphragm and a rod connecting the diaphragm to an advance mechanism of a distributor of the engine. The vacuum advance device is operated by the difference between the pressure at a signal port in the intake passage at an upstream side of the throttle valve of the engine and the pressure at a signal port provided in the wall of the intake passage at a position just above the throttle valve, the pressure thereat varying with the variation of the opening degree of the throttle valve. The vacuum advance device is so arranged as to retard the ignition timing at high engine speed by the pressure difference.

5 Claims, 10 Drawing Figures

SYSTEM FOR CONTROLLING THE IGNITION TIMING OF AN ENGINE

BACKGROUND OF THE INVENTION

The present invention relates to a system for controlling the ignition timing of an internal combustion engine having a turbocharger.

In an engine having a turbocharger, the pressure of the intake air is greatly increased by supercharging which results in an increase of the pressure of the mixture compressed in cylinders. Such a high supercharging pressure is apt to induce "knocking" in the engine.

Japanese patent laid open No. 56-990066 discloses a system for preventing this knocking. The system is provided with a signal port in the carburetor of the engine adjacent to the throttle valve and with a vacuum advance device, and it is adapted to control the ignition timing in the retard direction during supercharging operation and to control the timing in the advance direction at non-supercharging operation.

FIG. 1B shows the torque characteristic for different pressures at the signal port dependent on engine speed. When the pressure is higher than a positive pressure curve a, the ignition timing is changed in the retard direction, and when the pressure is lower than a negative pressure curve b, the ignition timing is shifted in the advance direction. FIG. 1A shows the ignition timing characteristic. As shown in FIGS. 1A and 1B, there is an insensitive zone between a and b. In other words, the characteristic is not continuous between peaks. Further, in the prior art, the amount of retarding of the ignition is determind only by the supercharging pressure without consideration of a factor relative to engine speed.

FIGS. 2A and 2B show supercharging characteristics from a point of view of engine characteristic, where FIG. 2A shows the characteristic of a low speed type turbocharger and FIG. 2B shows that of a high speed type turbocharger. In the engine having the low speed type turbocharger, it is not necessary to greatly change the ignition timing in the retard direction at a high engine speed zone, since supercharging efficiency decreases compared with a low engine speed zone. On the contrary, the ignition timing of the engine with the high speed type turbocharger should be retarded at a high engine speed zone because of high supercharging efficiency. These facts mean that the ignition timing should be controlled by pressure relative to engine speed in addition to supercharging pressure.

SUMMARY OF THE INVENTION

The object of the present invention is to provide a system for controlling the ignition timing of an engine to a proper value in dependency on a resultant factor of supercharging pressure and engine speed.

To this end, the system of the present invention comprises a vacuum advance device comprising two chambers defined by a diaphragm and a rod connecting the diaphragm to an advance mechanism of a distributor of the engine. The vacuum advance device is operated by the difference between the pressure at a first signal port in the intake passage at upstream side of the throttle valve of the engine and the pressure at a second signal port provided in the wall of the intake passage at a position just above the throttle valve. The pressure at the second signal port varies with the variation of the opening degree of the throttle valve. The vacuum advance device is so arranged as to retard the ignition timing at high engine speed by the pressure difference.

The other objects and features of this invention will be apparently understood from the following description with reference to the accompanying drawings.

DETAILED DESCRIPTION OF THE PREFERRED EMBODIMENTS

Figure 1:
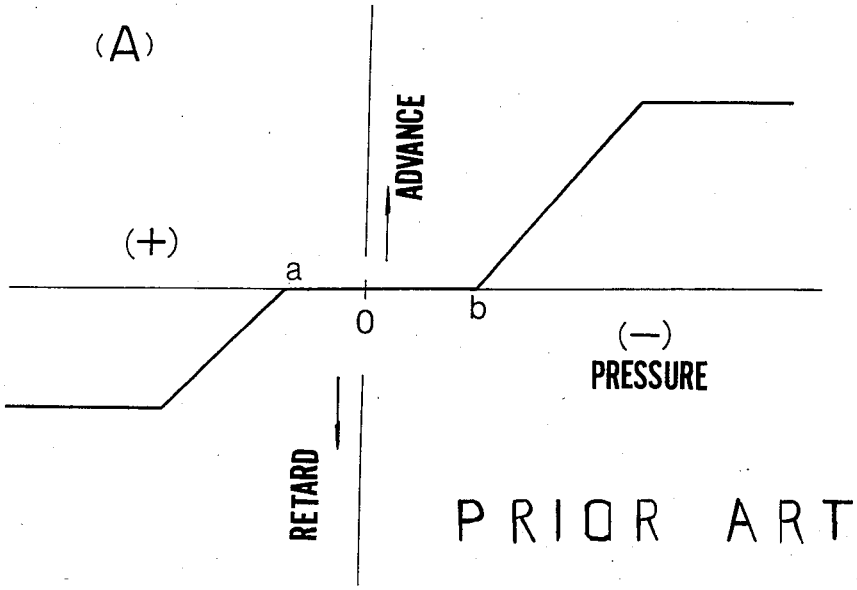
FIG. 1A shows ignition the timing characteristic of the prior art.
FIG. 1B shows torque characteristic for different pressure at a signal port in an intake passage.
Figure 1:
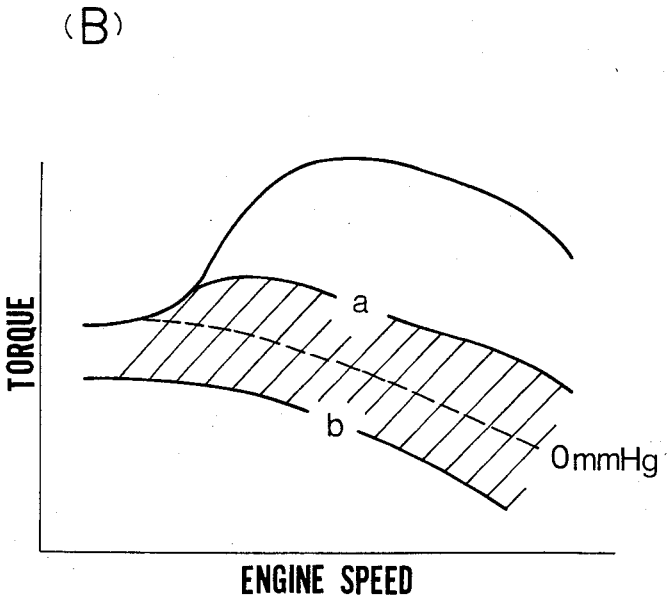
Figure 2:
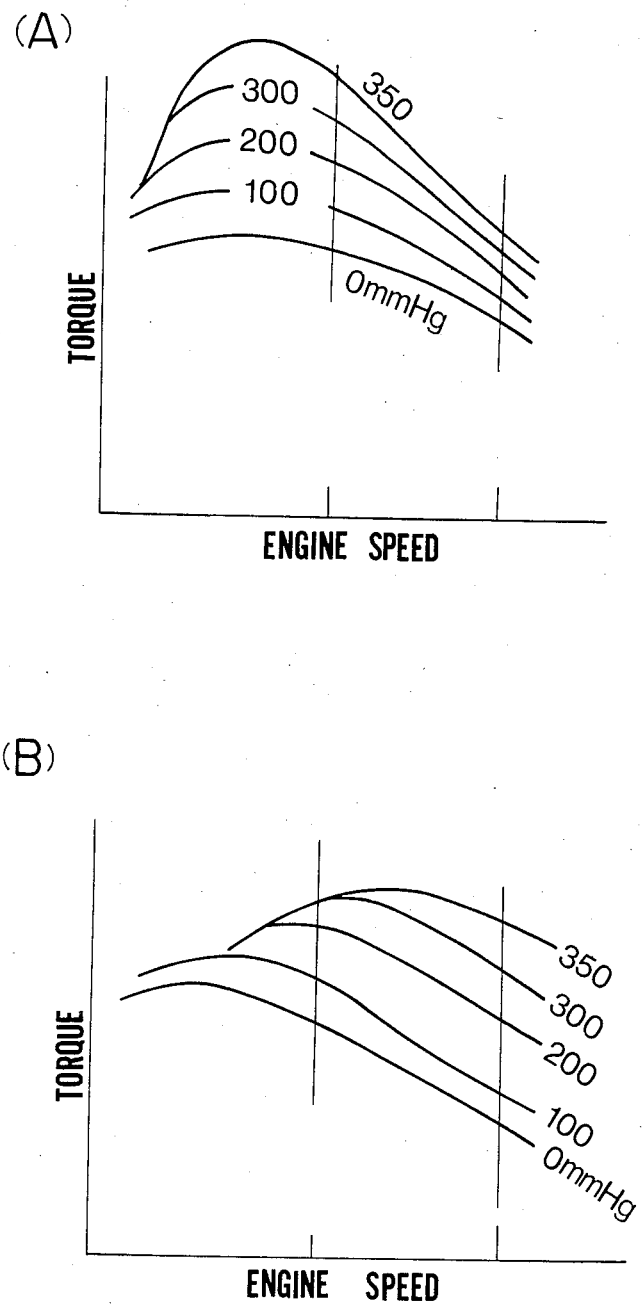
FIGS. 2A and 2B show supercharging characteristics of engines provided with a low speed type turbocharger and high speed type turbocharger, respectively.
Figure 3:
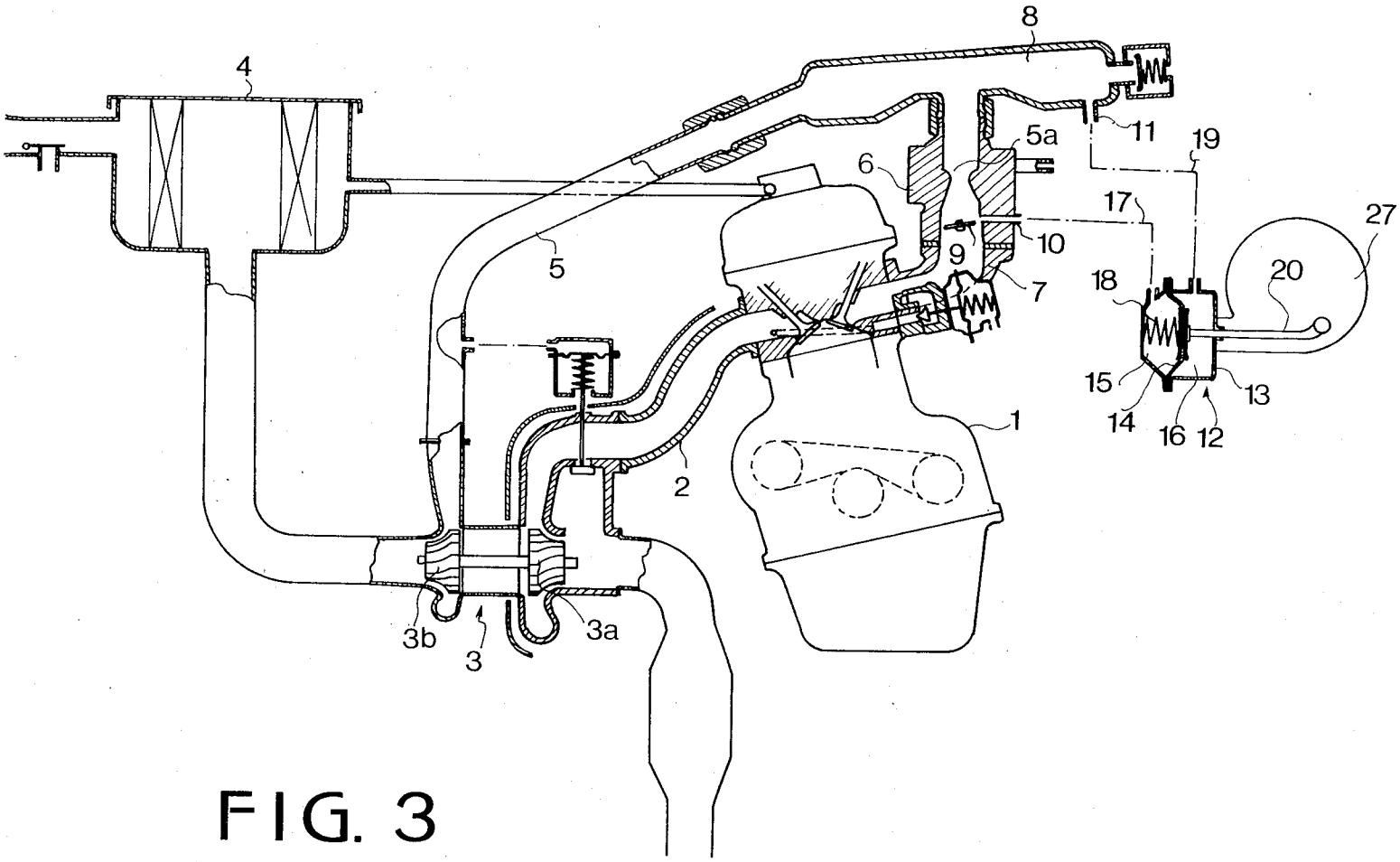
FIG. 3 is a schematic view showing a system according to the present invention.

Referring to FIG. 3, an internal combustion engine 1 is provided with a turbocharger 3 as a supercharger. The turbocharger 3 comprises a turbine **3*a* provided in an exhaust pipe 2 and a compressor 3*b* provided in an intake pipe 5 at the downstream side of an air-cleaner 4. The intake pipe 5 is communicated with an intake passage 5*a* at the upstream side of a carburetor 6 through a chamber 8 having a predetermined volume. The chamber 8 serves to diminish the pulsation of intake air pressure. The carburetor 6 communicates with the engine 1 through an intake manifold 7. A signal port 10 is provided in the wall of the carburetor 6 positioned just above the upward swinging end of a throttle valve 9 in its closed position, so that it is exposed to induction vacuum when the throttle valve is partly opened. Another signal port 11 is provided in the intake passage 5*a* at the upstream side of the throttle valve, for example in the wall of the chamber 8. A vacuum advance device 12 is employed in the system. The vacuum advance device 12 comprises a housing 13, and pressure chambers 15 and 16 defined by a diaphragm 14. The diaphragm 14 is connected to an advance mechanism of a distributor 27 by a rod 20. Chamber 15 is communicated with the signal port 10 through a passage 17 and chamber 16 is communicated with the signal port 11 through a passage 19. Diaphragm 14 is urged by a spring 18** in the retard direction.

Figure 4:
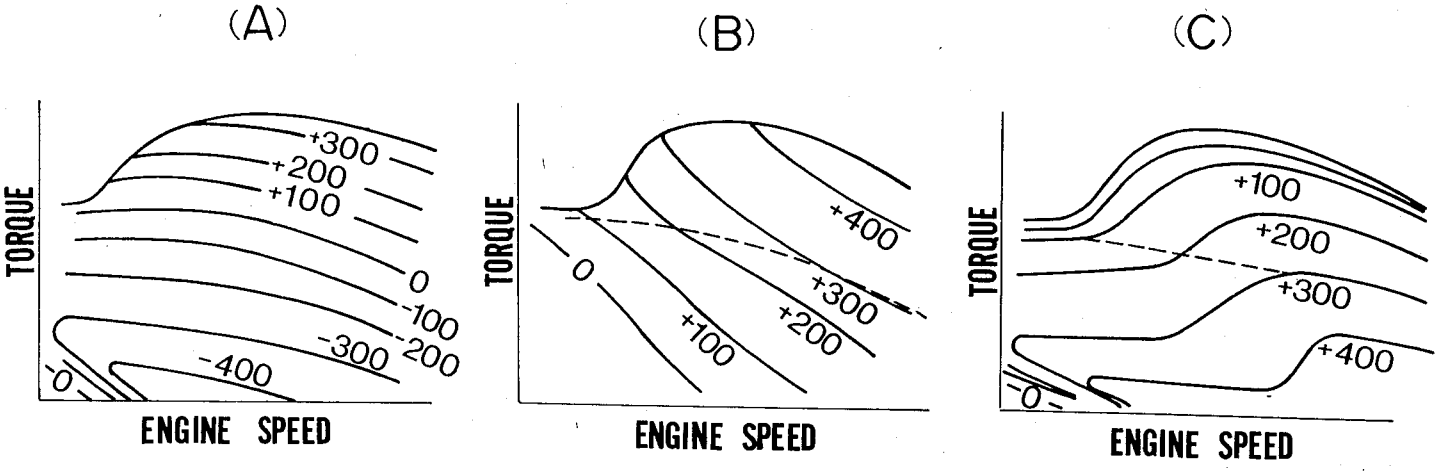
FIGS. 4A to 4C are graphs showing torque characteristics for different pressures in the system of the present invention.

In operation, diaphragm 14 is subjected to the difference between the pressure $P_2$ at signal port 11 and the pressure $P_1$ at signal port 10. FIG. 4A shows the pressure $P_1$ and FIG. 4B shows the pressure $P_2$, and FIG. 4C shows the difference $(P_2-P_1)$ which is effective on the diaphragm 14. Chamber 15 is applied with the pressure at the signal port 10 and the pressure in the chamber 15 is dependent on the position of throttle valve 9. When the opening degree of throttle valve 9 is smaller than a predetermined value, the turbocharger 3 does not operate to supercharge. In such a small degree throttle condition, the pressure at the port 10 is negative and the pressure at the port 11 is at atmospheric pressure, so that the vacuum in the chamber 15 deflects the diaphragm 14 in the advance direction against the spring 18. Accordingly, the ignition timing is advanced. When the throttle valve 9 is opened over a predetermined degree, the pressure at the port 10 becomes positive. Further, when the throttle valve opening degree exceeds a predetermined value, turbocharger 3 begins to supercharge and the pressure at port 11 becomes higher than the pressure at port 10. Accordingly diaphragm 14 is deflected in the retard direction. Thus, ignition timing is retarded.

Figure 5:
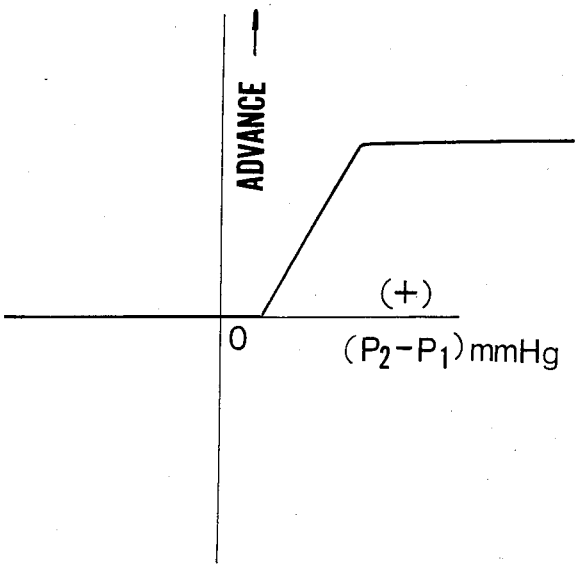
FIG. 5 is a graph showing the ignition characteristic in a system of the present invention.

In the system of the present invention, ignition timing at the wide throttle open condition is set by a governor provided in the distributor 27 in accordance with the required ignition characteristic, and the ignition timing at partial throttle open conditions is controlled by the pressure difference ($P_2-P_1$). FIG. 5 shows an ignition timing characteristic of a system according to the present invention. The characteristic continuously changes between peaks as shown in the graph, thereby to control the ignition timing to the proper value in dependency on conditions of engine operation in an entire operational range.

Figure 6:
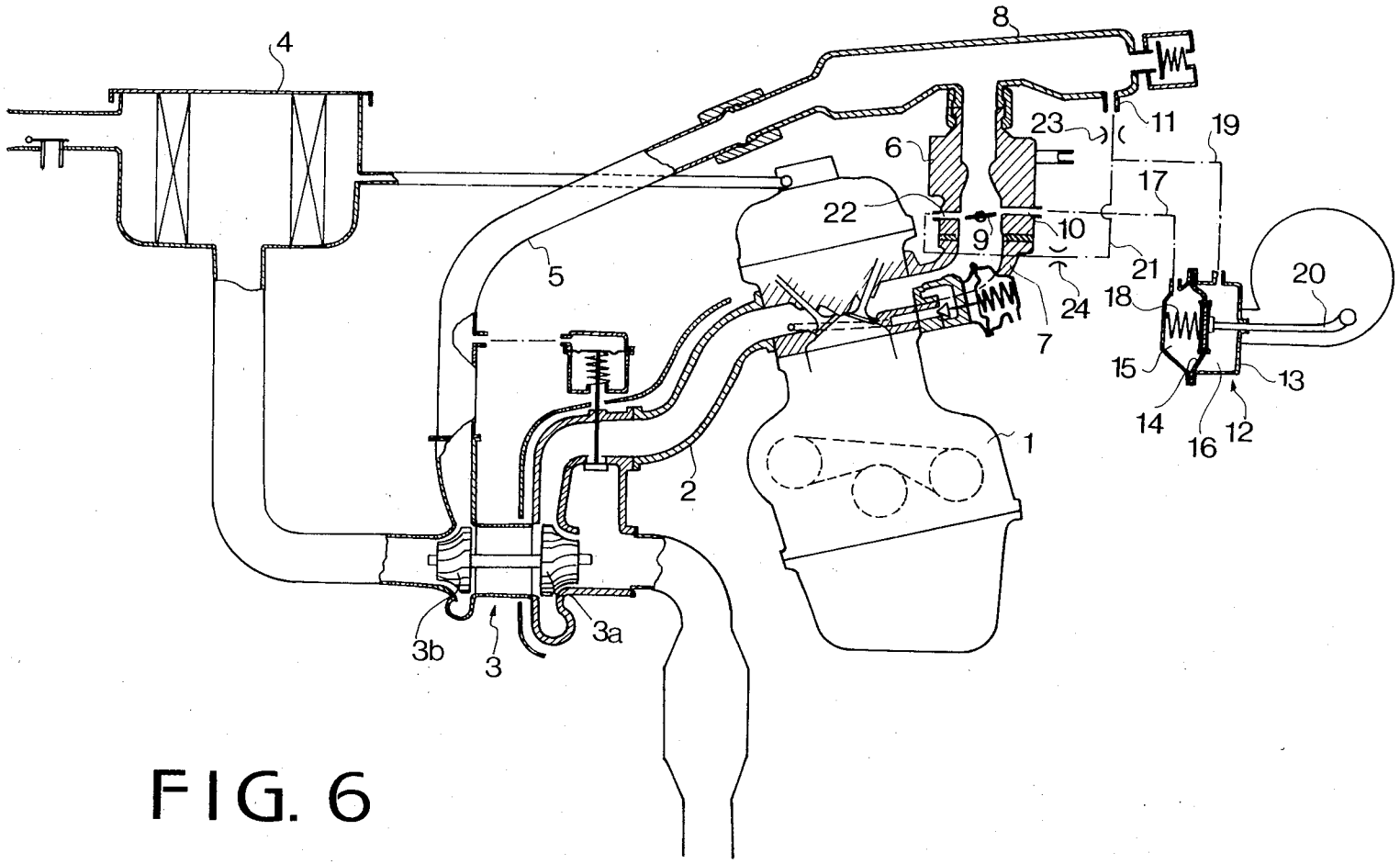
FIG. 6 is a schematic view showing another embodiment of the present invention.

Referring to FIG. 6 showing another embodiment of the present invention, a third signal port 22 is provided at a position above the downward swinging end of the throttle valve 9. The port 22 is communicated with the pressure chamber 16 through a passage 21 and passage 19. Orifices 23 and 24 are provided in passages 19 and 21. By adjusting the diameter of each orifice, the ignition timing characteristic can be finely controlled to the proper value at middle and high speed zone.

While the presently referred embodiments of the present invention have been shown and described, it is to be understood that this disclosure is for the purpose of illustration and that various changes and modifications may be made without departing from the spirit and scope of the invention as set forth in the appended claims.

What is claimed is:

1. In a system for controlling the ignition timing of an engine provided with a distributor having an advance mechanism, a throttle valve provided in an intake passage of the engine, and a supercharger having a compressor provided in said intake passage of the engine, the improvement wherein said compressor is provided in said intake passage upstream of the throttle valve, a pulsation-reducing chamber having a predetermined volume for diminishing pulsation of intake air pressure, said chamber constitutes a part of said intake passage and is provided between the compressor and the throttle valve, a vacuum advance device comprising first and second chambers between a diaphragm of the vacuum advance device, and a rod connecting said diaphragm to the advance mechanism of said distributor;

a first signal port provided in a wall of said intake passage at a position such that the pressure thereat varies with the variation of the opening degree of said throttle valve;

a first passage communicating said first chamber with said first signal port;

a second signal port communicated with the pulsation-reducing chamber;

a second passage communicating said second chamber with said second signal port; and said vacuum advance device being so arranged that said diaphragm is deflected by the difference between pressures at said first and second signal ports in the retard direction at higher engine speed.

2. The system for controlling the ignition timing of an engine according to claim 1 wherein said first signal port is located at a position just above the upward end of the throttle valve in its closed position so as to apply vacuum to said first chamber when the throttle valve is partly opened, so that the ignition timing is advance at low engine speed.

3. The system for controlling the ignition timing of an engine according to claim 1, further comprising a spring-biased relief valve is connected to said pulsation-reducing chamber.

4. A system for controlling the ignition timing of an engine provided with a distributor, a throttle valve, and a supercharger having a compressor provided in an intake passage of the engine, comprising;

a vacuum advance device comprising first and second chambers defined by a diaphragm and a rod connecting said diaphragm to an advance mechanism of said distributor;

a first signal port provided in the wall of said intake passage at a position the pressure at which varies with the variation of the opening degree of said throttle valve;

a first passage communicating said first chamber with said first signal port;

a second signal port communicated with said intake passage at the upstream side of the throttle valve;

a second passage communicating said second chamber with said second signal port;

said vacuum advance device being so arranged that said diaphragm is deflected by the difference between pressures at said first and second signal ports in the retard direction at higher engine speed;

said first signal port is located at a position just above the upward end of the throttle valve in its closed position so as to apply vacuum to said first chamber when the throttle valve is partly opened, so that the ignition timing is advanced at low engine speed;

a third signal port positioned just above the downward end of the throttle valve; and a third passage communicating said second chamber with said third signal port.

5. The system for controlling the ignition timing of an engine according to claim 4 wherein orifices are provided in said second and third passages, respectively.

* * * * *